US012352155B2

(12) United States Patent
McCormick

(10) Patent No.: US 12,352,155 B2
(45) Date of Patent: Jul. 8, 2025

(54) SENSOR TRANSPORTATION DEVICE

(71) Applicant: PETROMAC IP LIMITED, Auckland (NZ)

(72) Inventor: Stephen Peter McCormick, Auckland (NZ)

(73) Assignee: PETROMAC IP LIMITED, Auckland (NZ)

( * ) Notice: Subject to any disclaimer, the term of this patent is extended or adjusted under 35 U.S.C. 154(b) by 383 days.

(21) Appl. No.: 17/934,593

(22) Filed: Sep. 23, 2022

(65) Prior Publication Data

US 2023/0128181 A1 Apr. 27, 2023

(30) Foreign Application Priority Data

Oct. 22, 2021 (NZ) ..... 781598

(51) Int. Cl.
*E21B 47/01* (2012.01)

(52) U.S. Cl.
CPC ..... *E21B 47/01* (2013.01)

(58) Field of Classification Search
CPC ..... E21B 47/01; E21B 47/00; E21B 49/00; E21B 23/001
See application file for complete search history.

(56) References Cited

U.S. PATENT DOCUMENTS 4,438,810 A 3/1984 Wilkinson
6,536,531 B2 3/2003 Brunet
7,725,263 B2 * 5/2010 Sugiura ..... E21B 47/022 175/45
9,151,150 B2 * 10/2015 Fang ..... E21B 47/022
9,863,198 B2 1/2018 McCormick
2005/0252655 A1 * 11/2005 McKay ..... E21B 17/1057 166/241.3
2015/0308207 A1 * 10/2015 McCormick ..... E21B 17/10 104/138.2
2018/0038218 A1 * 2/2018 Hay ..... G01V 3/26
2018/0163529 A1 * 6/2018 Shah ..... E21B 37/02
2019/0383108 A1 * 12/2019 Massey ..... E21B 47/092

* cited by examiner

*Primary Examiner* — Eman A Alkafawi
*Assistant Examiner* — Dilara Sultana
(74) *Attorney, Agent, or Firm* — Niels Haun; Dann, Dorfman, Herrell & Skillman, P.C.

(57) ABSTRACT

A device for transporting a sensor assembly down a bore of a known diameter comprises a pair of wheels offset in a radial direction by a first radial distance from a longitudinal axis of the sensor assembly and at least one eccentric weight. The first radial distance and a lateral distance between the wheels and a diameter of the wheels configures the device so that, in use, a longitudinal axis of the sensor assembly is substantially coincident with a longitudinal axis of the bore when the wheels are in contact with a wall of the bore. The at least one eccentric weight is positioned so that a centre of mass of the combined device and sensor assembly is offset in the radial direction from the longitudinal axis of the sensor assembly by a second radial distance that is greater than the first radial distance to orient the device and sensor assembly by gravity in a most stable position with the rotational axis of the wheels and the centre of mass below the longitudinal axis of the sensor assembly with the wheels in contact with a low side of the wall of the bore.

23 Claims, 10 Drawing Sheets

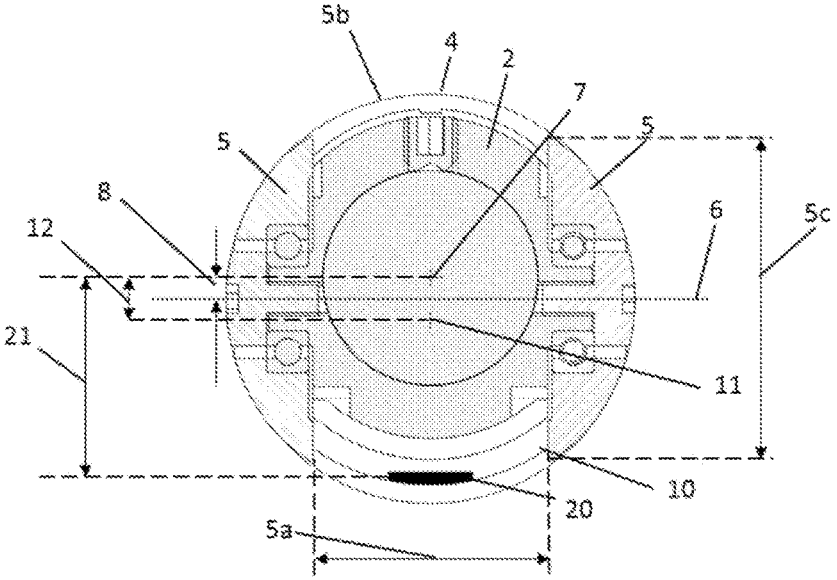
FIGURE 6
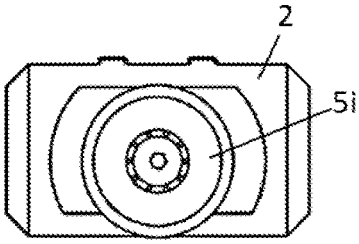
FIGURE 7A(I)
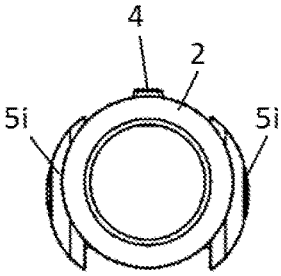
FIGURE 7A(II)
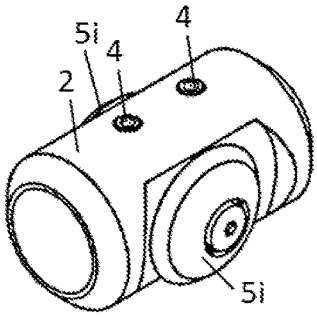
FIGURE 7A(III)
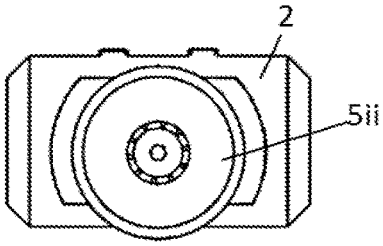
FIGURE 7B(I)
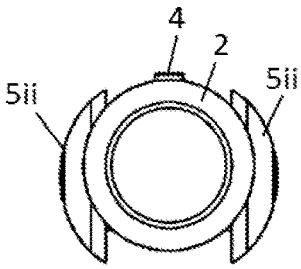
FIGURE 7B(II)
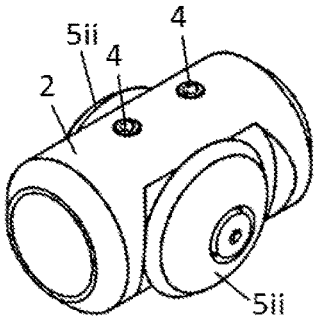
FIGURE 7B(III)
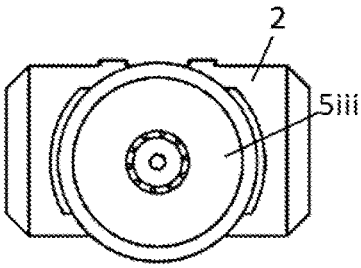
FIGURE 7C(I)
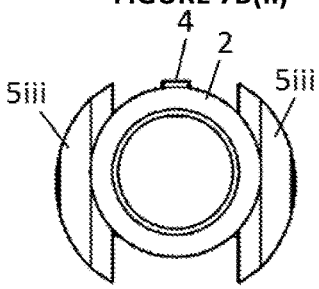
FIGURE 7C(II)
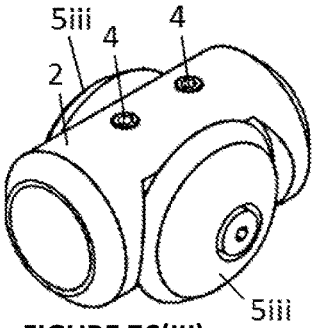
FIGURE 7C(III)

SENSOR TRANSPORTATION DEVICE

TECHNICAL FIELD

This invention relates to devices for use in transporting sensor equipment down a bore while maintaining the sensor equipment at a centreline of the bore. In particular, the invention relates to devices for use in transporting sensor equipment along a central axis of a wellbore for wireline logging.

BACKGROUND

Hydrocarbon exploration and development activities rely on information derived from sensors which capture data relating to the geological properties of an area under exploration. One approach used to acquire this data is through wireline logging. Wireline logging is performed in a wellbore immediately after a new section of hole has been drilled, referred to as open-hole logging. These wellbores are drilled to a target depth covering a zone of interest, typically between 1000-5000 meters deep. A sensor package or assembly, also known as a "logging tool" or "tool-string" is then lowered into the wellbore and descends under gravity to the target depth of the wellbore well. The logging tool is lowered on a wireline—being a collection of electrical communication wires which are sheathed in a steel cable connected to the logging tool. The steel cable carries the loads from the tool-string, the cable itself, friction forces acting on the downhole equipment and any overpulls created by sticking or jamming. Once the logging tool reaches the target depth it is then drawn back up through the wellbore at a controlled rate of ascent, with the sensors in the logging tool operating to generate and capture geological data.

Wireline logging is also performed in wellbores that are lined with steel pipe or casing, referred to as cased-hole logging. After a section of wellbore is drilled, casing is lowered into the wellbore and cemented in place. The cement is placed in the annulus between the casing and the wellbore wall to ensure isolation between layers of permeable rock layers intersected by the wellbore at various depths. The cement also prevents the flow of hydrocarbons in the annulus between the casing and the wellbore which is important for well integrity and safety. Oil wells are typically drilled in sequential sections. The wellbore is "spudded" with a large diameter drilling bit to drill the first section. The first section of casing is called the conductor pipe. The conductor pipe is cemented into the new wellbore and secured to a surface well head. A smaller drill bit passes through the conductor pipe and drills the surface hole to a deeper level. A surface casing string is then run in hole to the bottom of the hole. This surface casing, commonly 20" (nominal OD) is then cemented in place by filling the annulus formed between the surface casing and the new hole and conductor casing. Drilling continues for the next interval with a smaller bit size. Similarly, intermediate casing (e.g. 13⅜") is cemented into this hole section. Drilling continues for the next interval with a smaller bit size. Production casing (e.g. 9⅝" OD) is run to TD (total depth) and cemented in place. A final casing string (e.g. 7" OD) is cemented in place from a liner hanger from the previous casing string. Therefore, the tool-string must transverse down a cased-hole and may need to pass into a smaller diameter bore.

There is a wide range of logging tools which are designed to measure various physical properties of the rocks and fluids contained within the rocks. The logging tools include transducers and sensors to measure properties such as electrical resistance, gamma-ray density, speed of sound and so forth. The individual logging tools are combinable and are typically connected together to form a logging tool-string. Some sensors are designed to make close contact with the borehole wall during data acquisition whilst others are ideally centered in the wellbore for optimal results. These requirements need to be accommodated with any device that is attached to the tool-string. A wireline logging tool-string is typically in the order of 20 ft to 100 ft long and 2" to 5" in diameter.

In cased hole, logging tools are used to assess the strength of the cement bond between the casing and the wellbore wall and the condition of the casing. There are several types of sensors and they typically need to be centered in the casing. One such logging tool utilises high frequency ultrasonic acoustic transducers and sensors to record circumferential measurements around the casing. The ultrasonic transmitter and sensor is mounted on a rotating head connected to the bottom of the tool. This rotating head spins and enables the sensor to record azimuthal ultrasonic reflections from the casing wall, cement sheath, and wellbore wall as the tool is slowly winched out of the wellbore. Other tools have transmitters and sensors that record the decrease in amplitude, or attenuation, of an acoustic signal as it travels along the casing wall. It is important that these transducers and sensors are well centered in the casing to ensure that the data recorded is valid. Other logging tools that measure fluid and gas production in flowing wellbores may also require sensor centralisation. Logging tools are also run in producing wells to determine flow characteristics of produced fluids. Many of these sensors also require centralisation for the data to be valid.

In open hole (uncased wellbores), logging tools are used to scan the wellbore wall to determine the formation structural dip, the size and orientation of fractures, the size and distribution of pore spaces in the rock and information about depositional environment. One such tool has multiple sensors on pads that contact the circumference of the wellbore to measure micro-resistivity. Other tools generate acoustic signals which travel along the wellbore wall and are recorded by multiple receivers spaced along the tool and around the azimuth of the tool. As with the cased hole logging tools, the measurement from these sensors is optimised with good centralisation in the wellbore.

The drilling of wells and the wireline logging operation is an expensive undertaking. This is primarily due to the capital costs of the drilling equipment and the specialised nature of the wireline logging systems. It is important for these activities to be undertaken and completed as promptly as possible to minimise these costs. Delays in deploying a wireline logging tool are to be avoided wherever possible.

One cause of such delays is the difficulties in lowering wireline logging tools down to the target depth of the wellbore. The logging tool is lowered by a cable down the wellbore under the force of gravity alone. The cable, being flexible, cannot push the tool down the wellbore. Hence the operator at the top of the well has very little control of the descent of the logging tool.

The chances of a wireline logging tools failing to descend is significantly increased with deviated wells. Deviated wells do not run vertically downwards and instead extend downward and laterally at an angle from vertical. Multiple deviated wells are usually drilled from a single surface location to allow a large area to be explored and produced. As wireline logging tools are run down a wellbore with a cable under the action of gravity, the tool-string will drag along the low side or bottom of the wellbore wall as it travels downwards to the target depth. The friction or drag of the tool-string against the wellbore wall can prevent to tool descending to the desired depth. The long length of a tool string can further exacerbate problems with navigating the tool string down wellbore.

With reference to FIG. 1A, in deviated wells the weight of the tool-string 101 exerts a lateral force (PW) perpendicular to the wellbore wall 102*a*. This lateral force results in a drag force which acts to prevent the tool-string descending the wellbore 102. The axial component of tool-string weight (AW) acts to pull the tool-string down the wellbore and this force is opposed by the drag force which acts in the opposing direction. As the well deviation increases the axial component of tool weight (AW) reduces and the lateral force (PW) increases. When the drag resulting from the lateral force (PW) equals the axial component (AW) of tool-string weight the tool will not descend in the wellbore.

As hole deviation increases, the sliding friction or drag force can prevent the logging tool descending. The practical limit is 60° from the vertical, and in these high angle wells any device that can reduce friction is very valuable. The drag force is the product of the component of tool weight acting perpendicular to the wellbore wall and the coefficient of friction. It is desirable to reduce the coefficient of friction in order to reduce the drag force. The coefficient of friction may be reduced by utilising low friction materials, such as Teflon. The drag force may also be reduced by using wheels.

A common apparatus to centralise logging tools is a bow-spring centraliser. Bow-spring centralisers incorporate a number of curved leaf springs. The leaf springs are attached at their extremities to an attachment structure on the logging tool. The midpoint of the curved leaf spring (or bow) is arranged to project radially outward from the attachment structure and tool string. When the bow-spring centraliser is not constrained by the wellbore, the outer diameter of the bow-spring centraliser is greater than the diameter of the wellbore or casing in which it is to be deployed. Once deployed in the wellbore, the bow-springs are flattened and the flattened bow springs provide a centering force on the tool string. In deviated wells this centering force must be greater than the weight component of the tool string acting perpendicular to the wellbore or casing wall. Consequently, more centering force is required at greater well deviations. If the centering force is too small the centraliser will collapse and the tool sensors are not centered. If the centralising force is too great the excessive force will induce unwanted drag which may prevent the tool descending or cause stick-slip motion of the logging tool. Stick-slip is where the tool moves up the wellbore in a series of spurts rather than at a constant velocity. Stick-slip action will compromise or possibly invalidate the acquired measurement data. The practical limit for gravity decent with using bow spring centralisers is in the order of 60 degrees from the vertical. Wellbores are vertical at shallow depths and build deviation with depth. Consequently, the centralisation force that is necessary varies within the same wellbore. As the bow spring centraliser must be configured for the highest deviations, invariably there is more drag than what is necessary over much of the surveyed interval.

With bow spring centralisers, the centralising force is greater in small wellbores, as the leaf springs have greater deflection (more compressed), than in large wellbores. Consequently, stronger or multiple bowsprings are required in larger hole sizes.

At deviations greater than 60 degrees other methods must be used to overcome the frictional forces and enable the tool string to descend in the wellbore. One method is to use a drive device (tractor) connected to the tool string. Tractors incorporate powered wheels that forcibly contact the wellbore wall in order to drive the tool string downhole. Another method is to push the tool string down hole with drill pipe or coiled tubing. These methods involve additional risk, more equipment and involve more time and therefore cost substantially more.

In order to reduce the centraliser drag, wheels may be attached to the centre of the bow spring to contact the wellbore wall. However, the fundamental problems associated with the collapse of the leafspring or over-powering persist.

Another known type of centraliser consists of a set of levers or arms with a wheel at or near where the levers are pivotally connected together. There are multiple sets of arm assemblies disposed at equal azimuths around the central axis of the device. There are typically between three and six sets of arm assemblies with wheels. The ends of each arm set are connected to blocks which are free to slide axially on a central mandrel of the centraliser device. Springs are used to force these blocks to slide toward each other forcing the arms to defect at an angle to the centraliser (and tool string) axis so that the wheels can extend radially outward to exert force against the wellbore wall. With this type of device, the centering force depends on the type and arrangement of the energising apparatus or springs. The centraliser device is typically energised by means of either axial or radial spring or a combination of both. The advantage of this type of centraliser is that drag is reduced by the wheels which roll, rather than slide along the wellbore wall. An example pivoting arm centraliser is disclosed in U.S. Pat. No. 4,619,322. A further example is disclosed in U.S. Pat. No. 4,557,327.

One problem with pivoting arm type centralisers is that the centraliser can become hung up on wellbore restrictions or a change in wellbore diameter from a larger diameter to a smaller diameter. The risk of the wheels of a pivoting arm type centraliser being caught or damaged on a wellbore restriction is greater at larger diameter wellbores, as more of the wheel becomes exposed as the arms extend radially further outwards. A wellbore restriction may contact the exposed wheel radially inwards of the wheel's rotational axis with respect to a longitudinal axis of the centraliser, which acts to force the arms radially further outwards, causing the centraliser to catch or 'hang' on the wellbore restriction, resulting in a failed wellbore logging operation. The problem of a wheel being caught or damaged may be somewhat alleviated by providing small diameter wheels, so that the wheels do not project a great distance beyond ends of the centraliser arms. However, large diameter wheels are preferred to reduce friction and travel more easily over wellbore wall irregularities. There is therefore a conflict between a desire to provide small diameter wheels to reduce wheel damage or hang-ups and a desire to provide large diameter wheels to reduce friction.

A further issue with pivoting arm type centralisers is that these centralisers can fail in their ability to centralise a tool string in a well bore, due to inefficiency in the transfer of the radial movement of one arm to the other arms via the sliding blocks. The failure of these devices to centralise a tool string is exacerbated in smaller diameter well bores when the angle between the arms and the centreline of the centraliser is small. For example, at an arm angle of 10 degrees, a change in the wellbore diameter of 10 mm (5 mm radial displacement) results in an axial displacement of less than 1 mm. With such a small axial movement of the sliding blocks, clearances between mechanical components such as in pivot points, bearings and the sliding members causes the centraliser device to fail to centralise the tool string since the radial displacement of one of the arm assemblies is not transferred sufficiently accurately to other arm assemblies through the sliding blocks. This results in the tool string running off centre which in turn can cause the tool string sensors to return erroneous data.

The reference to any prior art in the specification is not, and should not be taken as, an acknowledgement or any form of suggestion that the prior art forms part of the common general knowledge in any country.

DISCLOSURE OF INVENTION

It is an object of the present invention to address any one or more of the above problems or to at least provide the industry with a useful device for centering sensor equipment in a bore or pipe.

According to one aspect of the present invention there is provided a device for transporting a sensor assembly down a bore of a known diameter, the device comprising:

at least one engagement structure to connect the device to the sensor assembly;

a pair of wheels arranged to rotate about an axis of rotation substantially perpendicular to and offset in a radial direction by a first radial distance from a longitudinal axis of the sensor assembly when the device is connected to the sensor assembly; and at least one eccentric weight;

wherein the first radial distance and a lateral distance between the wheels and a diameter of the wheels configures the device so that, in use, a longitudinal axis of the sensor assembly is substantially coincident with a longitudinal axis of the bore when the wheels are in contact with a wall of the bore; and wherein the at least one eccentric weight is positioned so that a centre of mass of the combined device and sensor assembly is offset in the radial direction from the longitudinal axis of the sensor assembly by a second radial distance that is greater than the first radial distance, to orient the device and sensor assembly by gravity during use in a most stable position with the rotational axis of the wheels and the centre of mass below the longitudinal axis of the sensor assembly with the wheels in contact with a low side of the wall of the bore.

In some embodiments, the rotational axis of the wheels and the centre of mass are on the same side of a plane parallel to the rotational axis of the wheels and coincident with the longitudinal axis of the sensor assembly.

In some embodiments, the centre of mass of the combined device and sensor assembly is located in a plane coincident with the longitudinal axis of the sensor assembly and perpendicular to the rotational axis of the wheels.

In some embodiments, the shortest distance between the centre of mass of the combined device and sensor assembly and the wall of the bore is when the pair of wheels is in contact with the wall of the bore.

In some embodiments, a radial extremity of the eccentric weight is adjacent the wall of the bore when the wheels are in contact with the wall of the bore. For example, the radial extremity is within ⅛ in of the wall of the bore with the wheels in contact with the wall of the bore. The radial extremity of the eccentric weight is curved. The curvature of the outer extremity is concentric with the wall of the bore.

In some embodiments, the wheels have a diameter greater than or equal to a diameter, height, or width of the sensor assembly.

In some embodiments, a section diameter of the pair of wheels is greater than a maximum outside diameter of the tool string.

In some embodiments, the device comprises a body or frame providing the engagement structure, the body or frame comprising axles for rotationally supporting the pair of wheels to rotate on the rotational axis, and an opening to receive a section of the sensor assembly to couple the wheels to the sensor assembly.

In some embodiments, the device is configured for use in a bore with a wall comprising a magnetic material and the device comprises one or more magnets positioned to bias the device against the wall of the bore by a magnetic force to maintain contact between the pair of wheels and the wall of the bore.

In some embodiments, the magnets or the magnetic force and the centre of mass of the combined device and sensor assembly are azimuthally aligned from a longitudinal axis of the sensor assembly.

In some embodiments, the magnets are offset from the longitudinal axis by a third radial distance to be positioned adjacent to the wall of the bore with the wheels in contact with the wall of the bore.

In some embodiments, the magnets are located at a radial extremity of the eccentric weight.

In some embodiments, the magnets are positioned within ⅛ in of the wall of the bore with the wheels in contact with the wall of the bore.

In some embodiments, the shortest distance between the magnets and the bore wall is when the pair of wheels is in contact with the wall of the bore.

In some embodiments, the magnets provide a magnetic force sufficient to maintain contact between the wheels and the wall of the bore in a vertical section of the bore.

In some embodiments, with the wheels in contact with a low side of a deviated section of the bore the magnetic force and the orienting force by gravity are azimuthally aligned.

In some embodiments, the device is configured to position the longitudinal axis of the sensor assembly within 0.2 inch of the longitudinal axis of the bore.

In some embodiments, the device comprises:

a first engagement structure to connect the wheels to the sensor assembly and prevent relative rotation therebetween, and a second engagement structure to connect the eccentric weight to the sensor assembly and prevent relative rotation therebetween.

In some embodiments, the device is a passive device, without requiring power and with the device descending down a bore by free-wheeling of the wheels only.

In some embodiments, the device is adapted for transporting a wireline logging tool string in a wellbore during a wireline logging operation.

According to another aspect of the present invention there is provided a system for providing a device as claimed in any one of the preceding claims, the system comprising:

a body or frame providing the engagement structure and comprising axles for rotationally supporting the pair of wheels to rotate on the rotational axis, the at least one eccentric weight, and a plurality of said pairs of wheels, each pair of wheels being of a different diameter to the other pairs of wheels, the plurality of pairs of wheels corresponding to a plurality of bore diameters or bore diameter ranges, and wherein each pair of wheels is interchangeably couplable to the axles to selectively configure the device for use in a bore having a diameter selected from the plurality of bore diameters or diameter ranges, such that, in use, the longitudinal axis of the sensor assembly is substantially coincident with a longitudinal axis of the bore of the selected diameter when the wheels are in contact with the wall of the bore.

In some embodiments, the system comprises:

a plurality of eccentric weights, each weight having a different radial height to the other eccentric weights, the plurality of eccentric weights corresponding to the plurality of bore diameters or diameter ranges.

In some embodiments, the body or frame is a frame assembly comprising a bearing assembly mounted to each axle, and wherein each pair of wheels is interchangeably mountable to the bearing assemblies.

In some embodiments, the device comprises an interface structure to releasably mount each wheel to a respective bearing assembly.

In some embodiments, the interface structure comprises a first connector part attached to the wheel and a second connector part attached to the bearing assembly, the first and second connector parts comprising complementary features configured to engage to releasably retain the wheel on the bearing.

In some embodiments, the first connector part comprises inwardly extending projections and the second connector part comprises outwardly extending projections, the inward and outward projections configured to be engaged by relative rotation between the first connector part and the second connector part to mount the wheel to the bearing assembly.

In some embodiments, the interface structure comprises a locking member to be received through the first and second connector parts when engaged to lock the wheel to the bearing assembly.

In some embodiments, the locking member is received through complementary said inner and outer projections when engaged.

In some embodiments, the wheel comprises an aperture to allow the locking member to be pressed into the first and second connector parts from an outer side of the wheel.

In some embodiments, the body has a recess to receive the locking member when pressed through the first and second connector parts from the outer side of the wheel.

In some embodiments, the recess captures the locking member to prevent rotation of the second connector part to allow the wheel and first connector part to be rotated relative to the second connector part to remove the wheel off the bearing and second connector part.

According to another aspect of the present invention there is provided a wireline logging tool string comprising one or more elongate sensor assemblies and one or more devices as described above for transporting the wireline logging tool string in a wellbore during a wireline logging operation.

According to another aspect of the present invention there is provided a method for transporting a sensor assembly down a bore, the method comprising:

providing a device as described above, and connecting the device to the sensor assembly, and conveying the device and sensor assembly down a bore with the wheels in contact with the wall of the bore so that the longitudinal axis of the sensor assembly is substantially coincident with a longitudinal axis of the bore and with the device and sensor assembly oriented by gravity in the most stable position with the rotational axis of the wheels and the centre of mass below the longitudinal axis of the sensor assembly when the wheels are in contact with a low side of the wall in a deviated section of the bore.

In some embodiments, the method comprises:

providing a system as described above, and selecting a said pair of wheels from the plurality of pairs of wheels corresponding to a diameter of the bore, connecting the selected pair of wheels to the axles, connecting the device to the sensor assembly, and conveying the device and sensor assembly down a bore with the wheels in contact with the wall of the bore so that the longitudinal axis of the sensor assembly is substantially coincident with a longitudinal axis of the bore and with the device and sensor assembly oriented by gravity in the most stable position with the rotational axis of the wheels and the centre of mass below the longitudinal axis of the sensor assembly when the wheels are in contact with a low side of the wall in a deviated section of the bore.

In some embodiments, the system comprises a plurality of eccentric weights and the method comprises:

selecting a said weight with a radial height corresponding to the diameter of the bore, and connecting the wheels and eccentric weight to the sensor assembly.

Unless the context suggests otherwise, the term "wellbore" or similar terms should be understood to also refer to a casing pipe within a wellbore. Thus, the term 'wellbore wall' may refer to the wall of a casing within a wellbore.

Unless the context suggests otherwise, the term "tool string" refers to an elongate sensor package or assembly also known in the industry as a "logging tool" and may include components other than sensors such as guide and orientation devices and carriage devices attached to sensor components or assemblies of the tool string. A tool string may include a single elongate sensor assembly, or two or more sensor assemblies connected together. The terms 'tool string' and 'sensor assembly' may be used interchangeably.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to". Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

FIG. 2A is a side view and FIG. 2B is an end view with the tool string and device positioned in a wellbore.

FIG. 3A is a bottom view, FIG. 3B is a side view, FIG. 3C is an end view, FIG. 3D is a top view, and FIGS. 3E and 3F are isometric views from above and below.

FIG. 4A is a cross section on line A-A in FIG. 4B, FIG. 4B is a side view, FIG. 4C is an end view, FIG. 4D is a top view, and FIG. 4E is an isometric view from above.

FIG. 6 provides a cross section of the device in FIGS. 3A to 3F on a plane coincident with a rotational axis of wheels of the device and perpendicular to the longitudinal axis of the device (i.e. section line B-B in FIG. 3B).

FIGS. 7A(I) to 7A(III) illustrate a body or frame and smaller diameter wheels of a plurality of pairs of wheels for the device of FIGS. 3A to 3F. FIG. 7A(I) is a side view, FIG. 7A(II) is an end view, and FIG. 7A(III) is an isometric view.

FIGS. 7B(I) to 7B(III) provide the same views as FIGS. 7A(I) to 7A(III) but with intermediate sized wheels of a plurality of pairs of wheels attached to the body or frame.

FIGS. 7C(I) to 7C(III) provide the same views as FIGS. 7A(I) to 7A(III) but with larger diameter wheels of a plurality of pairs of wheels attached to the body or frame.

FIG. 8A(I) is a side view and FIG. 8A(II) is an end view of the eccentric weigh illustrated within a wellbore as it would be positioned when connected to a tool string.

FIG. 10A(I) is a side view. FIG. 10A(II) is an end view in a bore.

FIG. 10B(I) is a side view in a bore. FIG. 106(II) is an end view in a bore.

FIG. 10C(I) is a side view in a bore. FIG. 10C(II) is an end view in a bore.

BEST MODES FOR CARRYING OUT THE INVENTION

Figure 1A:
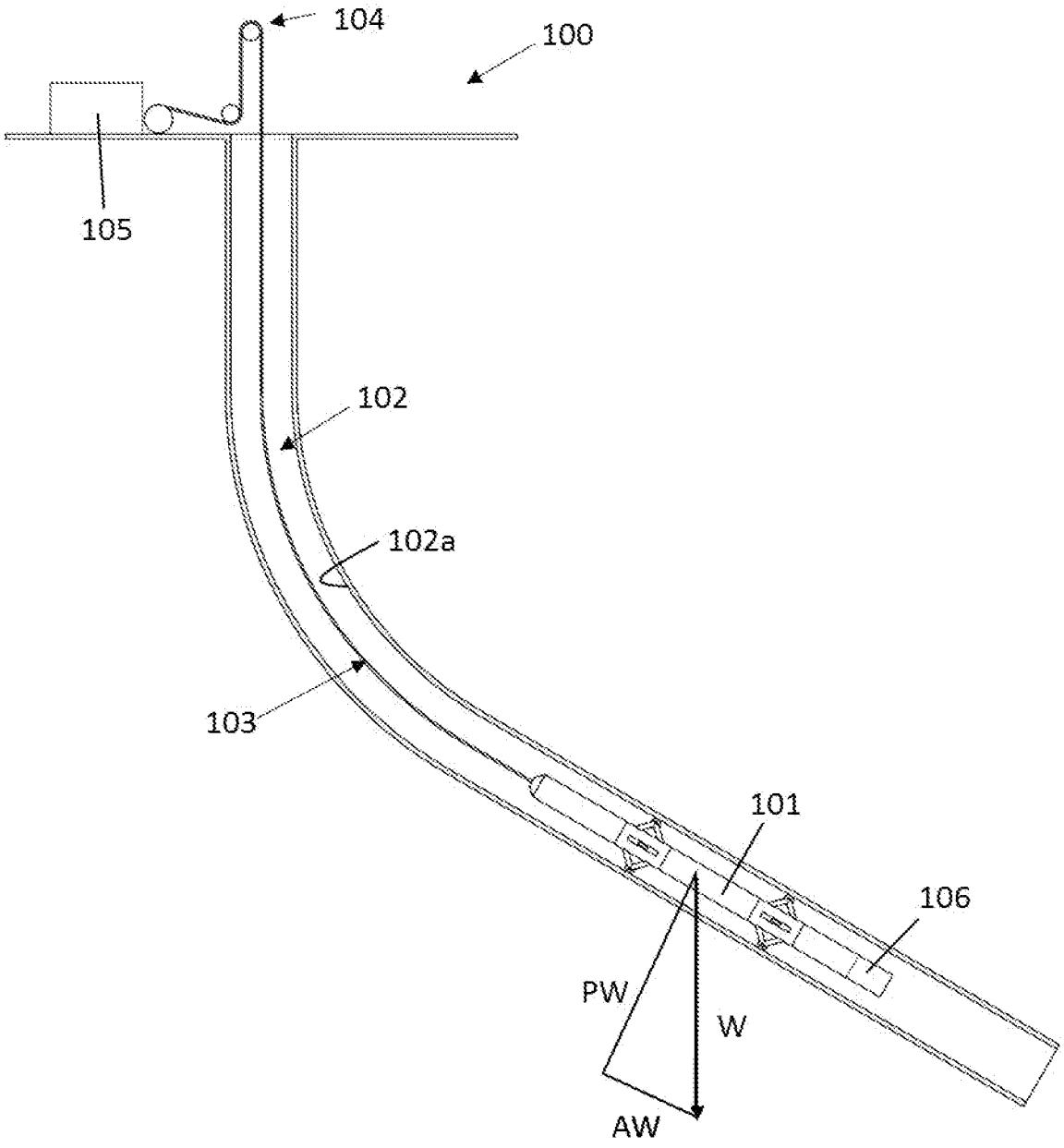
FIG. 1A is a schematic representation of a well site and a tool string descending down a wellbore in a wireline logging operation. The tool string is centralised and carried by lever arm centralisers as known in the art.
Figure 1B:
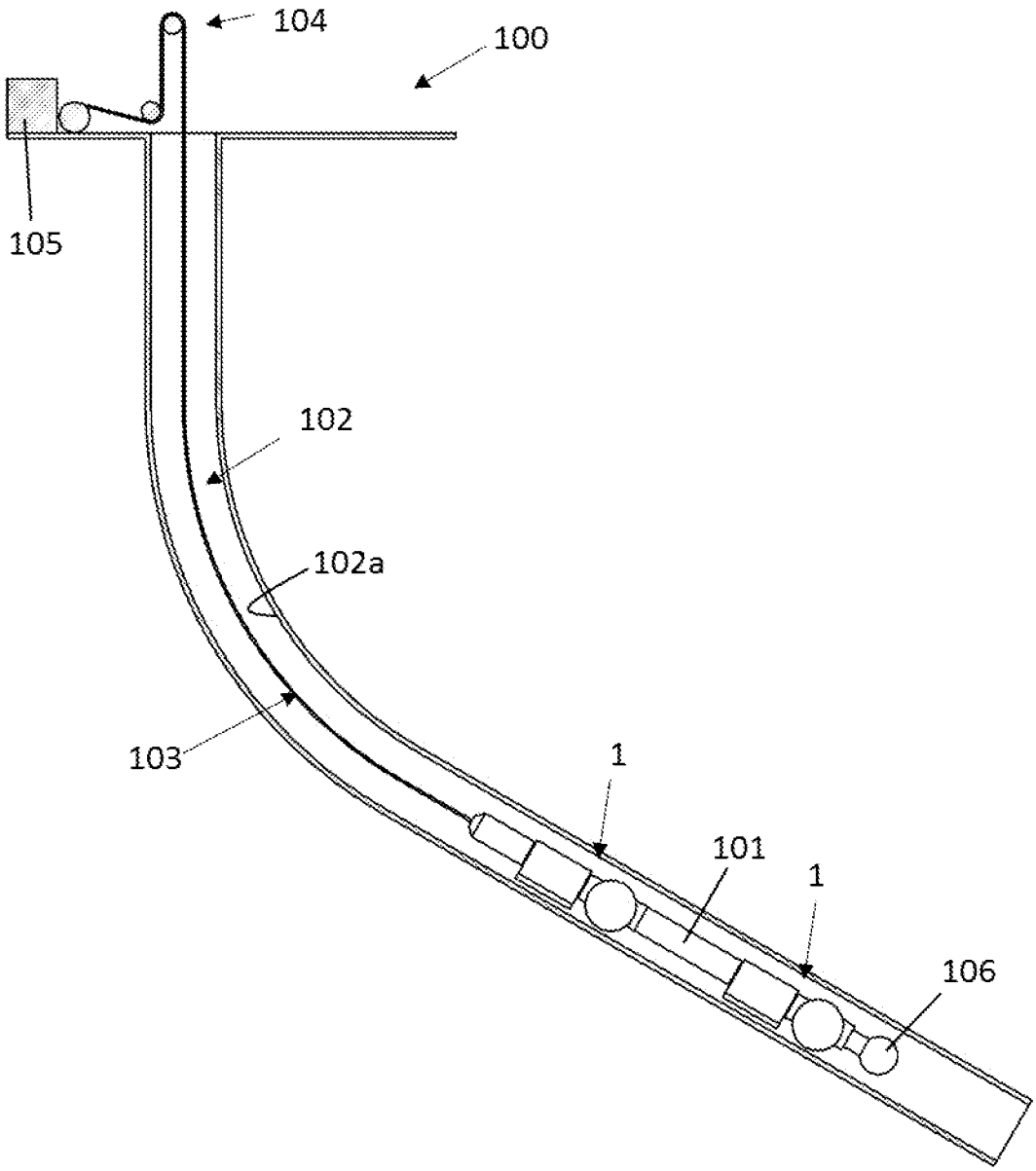
FIG. 1B is a schematic representation of a well site and a tool string descending down a wellbore in a wireline logging operation. The tool string is centralised and carried a pair of transportation a devices according to at least one embodiment of the present invention.

FIG. 1B provides a schematic representation of a well site 100. A 'sensor assembly' or 'logging tool string' 101 is lowered down the wellbore 102 on a wireline 103. Wellsite surface equipment includes sheave wheels 104 typically suspended from a derrick and a winch unit 105 for uncoiling and coiling the wireline to and from the wellbore, to deploy and retrieve the logging tool 101 to and from the wellbore to perform a wellbore wireline logging operation. The logging tool string 101 may include one or more logging tools each carrying one or more sensors 106 coupled together to form the logging tool string 101. The wireline 103 includes a number of wires or cables to provide electrical power to the one or more sensors 106 and transmit sensor data to the wellsite surface. One or more centralising transportation devices 1 are provided to the logging tool 101 to centralise the logging tool 101 in the wellbore 102 and carry the logging tool down the wellbore.

Figure 2A:
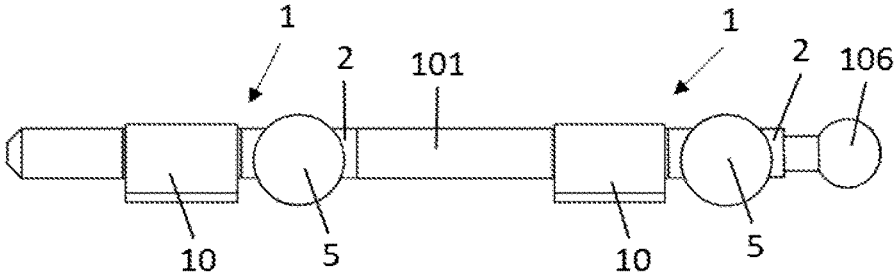
FIGS. 2A and 2B are schematic representations of a tool string with two transportation devices according to at least one embodiment of the present invention.
Figure 2B:
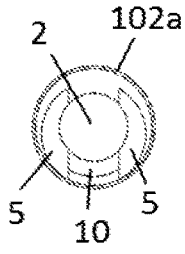
Figure 3A:
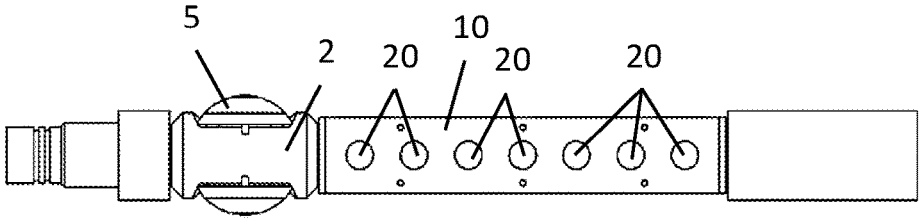
FIGS. 3A to 3F illustrate a transportation device 1 according to at least one embodiment of the present invention connected to a tool string.
Figure 3B:
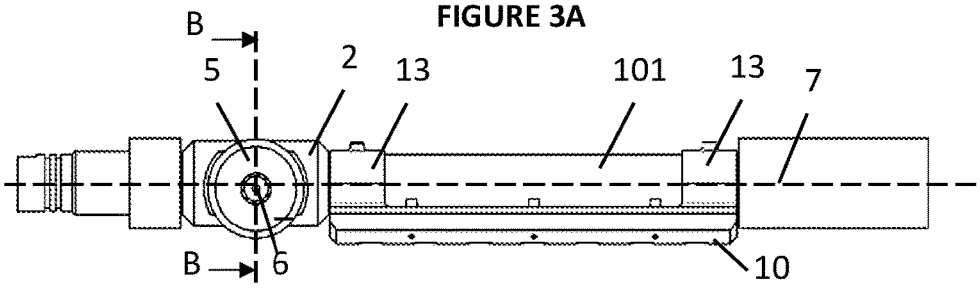
Figure 3C:
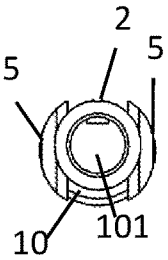
Figure 3D:
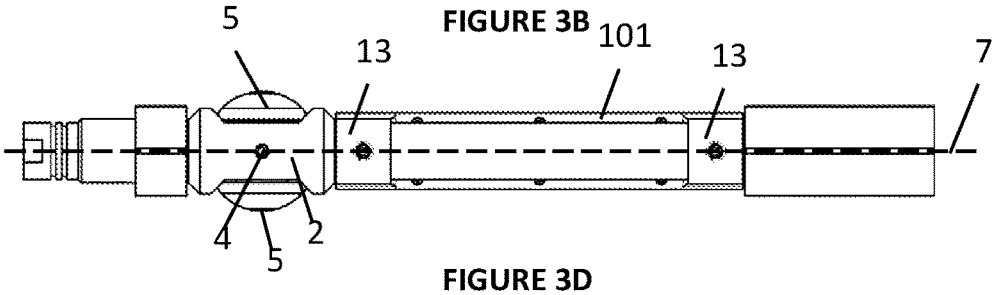
Figure 3E:
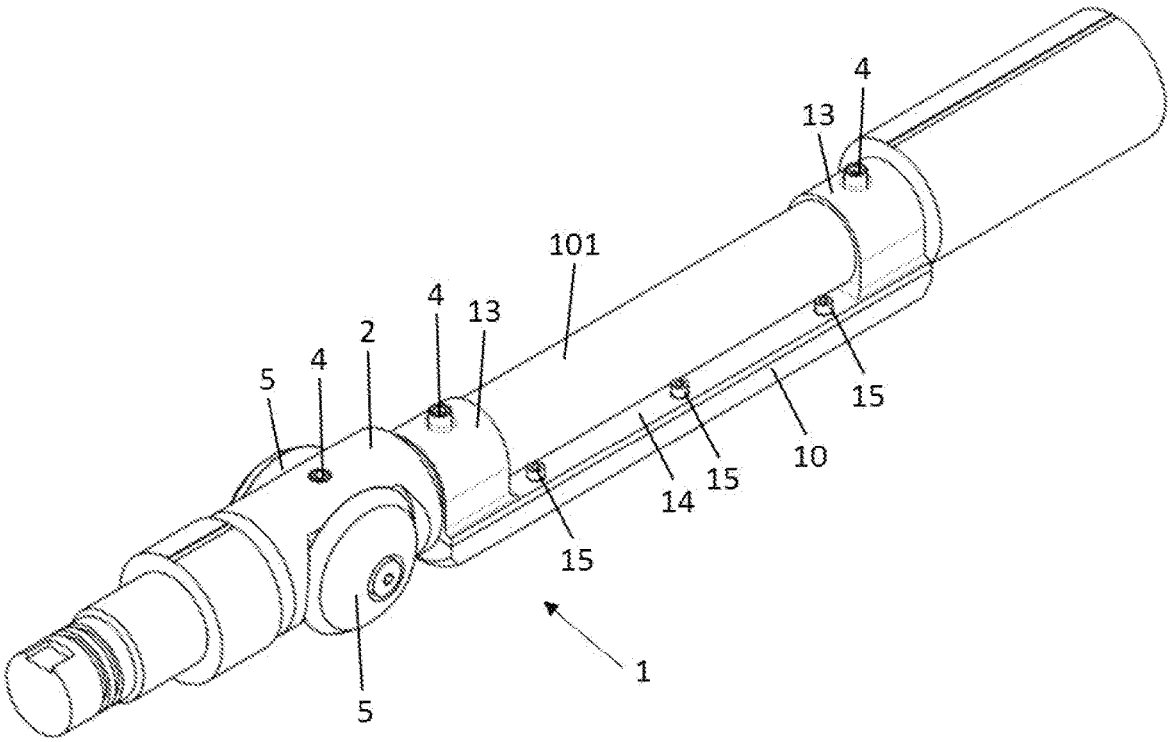
Figure 3F:
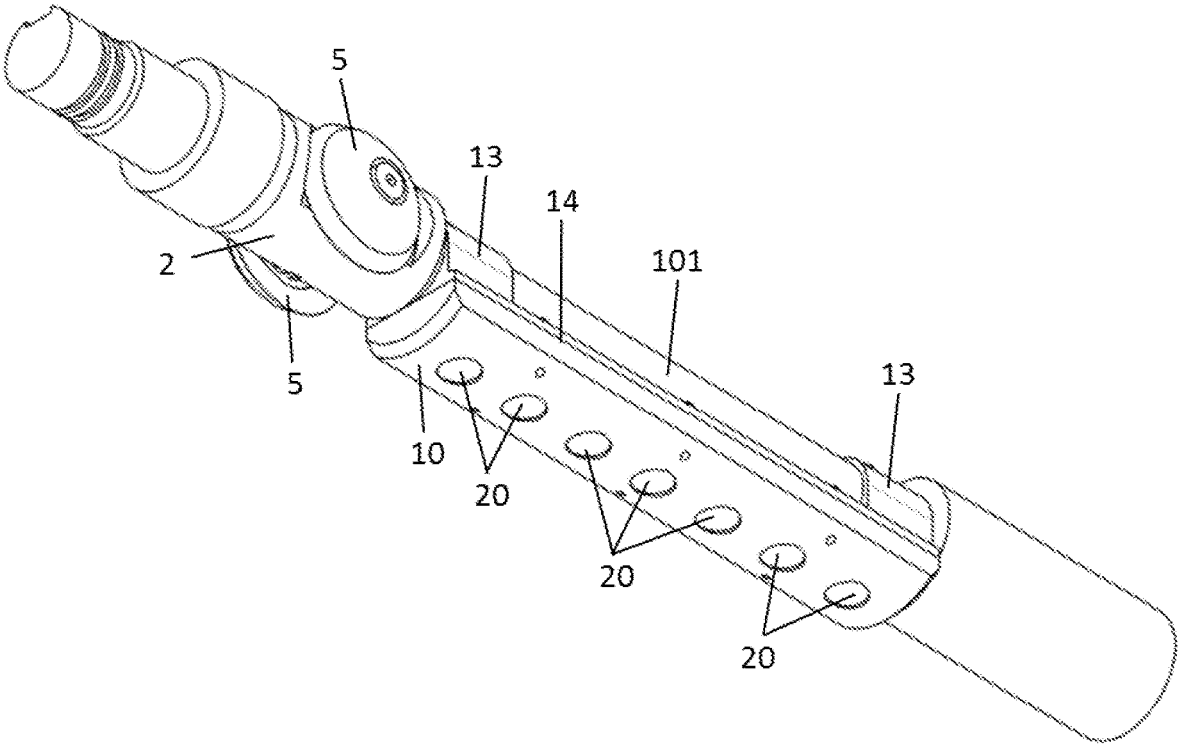
Figure 4A:
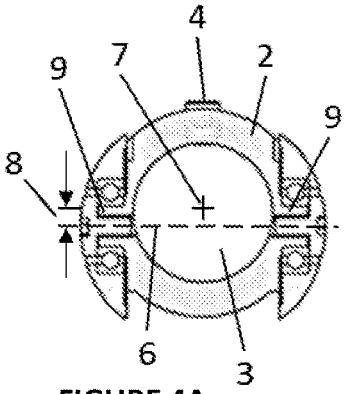
FIGS. 4A to 4E illustrate a frame or body and wheels of the device of FIGS. 3A to 3F.
Figure 4B:
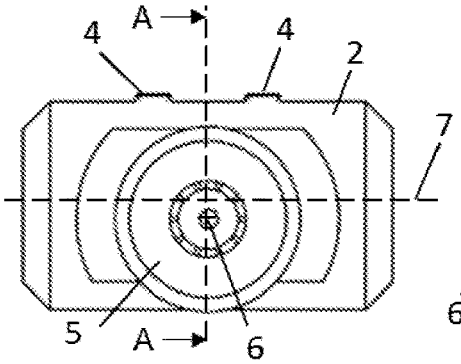
Figure 4C:
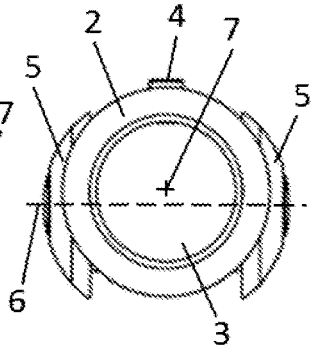
Figure 4D:
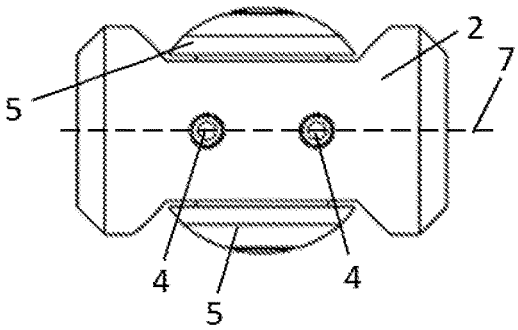
Figure 4E:
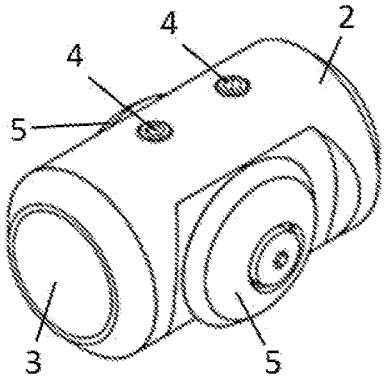
Figure 5:
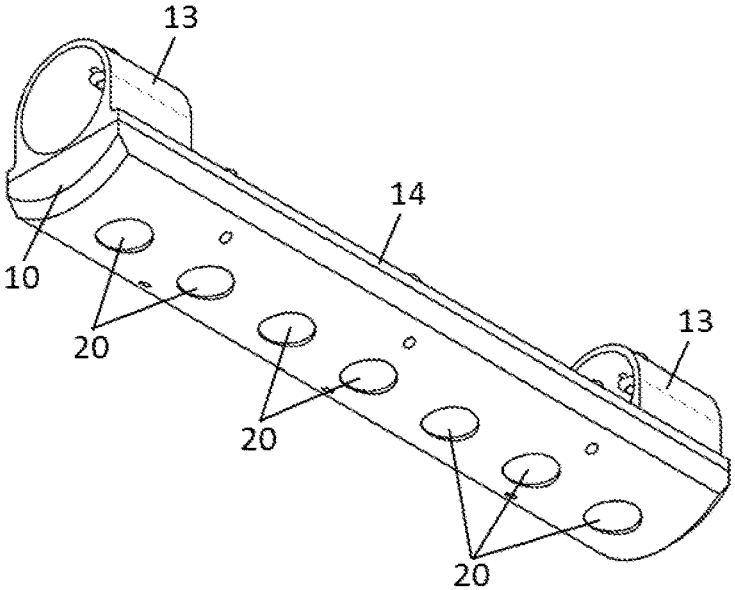
FIG. 5 provides an isometric view from below of an eccentric weight of the device of FIGS. 3A to 3F.
Figure 8A:
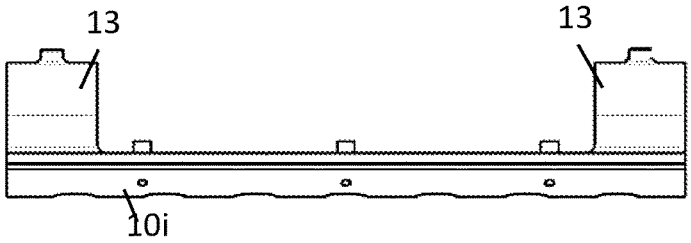
FIGS. 8A(I) and 8A(II) illustrate a smaller eccentric weight of a plurality of eccentric weights for the device of FIGS. 3A to 3F.
Figure 8B:
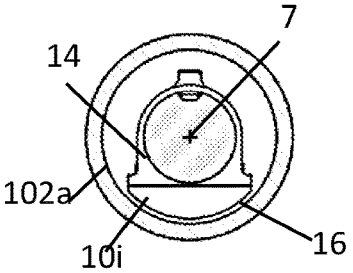
FIGS. 8B(I) and 8B(II) provides the same views as FIGS. 8A(I) and 8A(II) but for an intermediate sized weight of a plurality of eccentric weights.
Figure 8B:
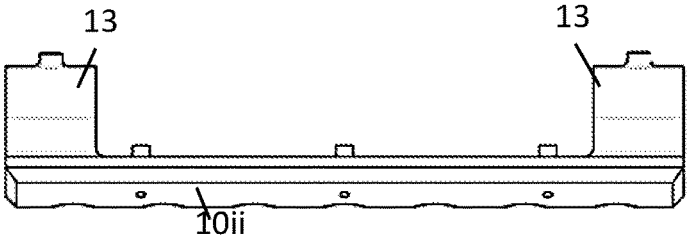
Figure 8C:
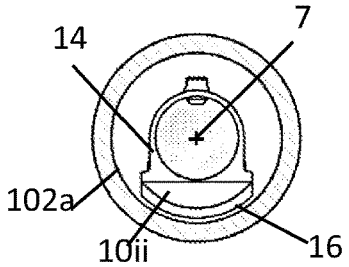
FIGS. 8C(I) and 8C(II) provides the same views as FIGS. 8A(I) and 8A(II) but for a larger sized weight of a plurality of eccentric weights.
Figure 8C:
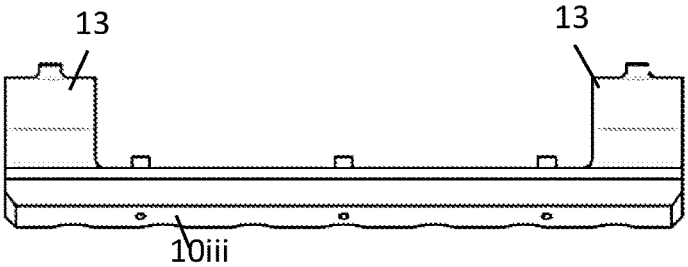

FIGS. 2A and 2B present schematic illustrations of a pair of centralising transportation devices 1 connected to a tool string 101. The transportation device 1 comprises a body or frame 2 configured to connect the device 1 to the tool string 101. The body or frame 2 has a longitudinally extending opening 3 (refer FIG. 4A) to receive a section of the tool string 101. The body or frame 2 is slid over the tool string 101 to couple the device 1 to the tool string 101. The body or frame 2 provides an engagement structure to connect the device 1 to the tool string 101. The body or frame 2 may be provided with one or more features to prevent relative movement between the tool string and the device. For example, illustrated embodiments comprise one or more screws 4 that extend through the frame or body 2 to the opening 3 to engage the tool string 101 received in the body or frame. The screws prevent relative axial movement between the device 1 and the tool string 101. The screws prevent relative rotation between the device 1 and the tool string 101.

A pair of wheels 5 are rotationally coupled to the body or frame 2. With reference to FIGS. 3A to 6, the wheels 5 are arranged to rotate about an axis of rotation 6 substantially perpendicular to a longitudinal axis 7 of the tool string 101 when the device 1 is connected to the tool string 101. The rotational axis 6 is offset from the longitudinal axis 7 by a first radial distance 8 (refer FIGS. 4A and 6) in a radial direction perpendicular to the rotational axis 6 of the wheels 5. The wheels 5 are of a diameter such that the diameter 5*c*

(refer FIG. 6) of the wheels 5 together with a lateral distance 5*a* between the wheels and the radial offset 8 of the rotational axis from the longitudinal axis 7 of the tool string positions the longitudinal axis 7 of the tool string at the centre of the wellbore 102 when the wheels 5 are in contact with the wall 102*a* of the bore 102. This configuration centralises the toolstring 101 in the wellbore 102 as the device 1 travels down the well bore on the wheels 5 and as the device is retrieved up the wellbore 102 on the wheels 5 during a wireline logging operation. With the tool string 101 centred in the wellbore, the longitudinal axis 7 of the tool string, or the longitudinal axis of the opening through the frame for receiving the tool string, is substantially coincident with the longitudinal axis of the bore 102. The longitudinal axis 7 of the tool string 101 or opening 3 of the body or frame 2 of the device 1 is considered substantially coincident with the longitudinal axis of the bore 102 when the longitudinal axis 7 of the tool string/opening 3 is within 0.2 inch or 5 mm of the longitudinal axis of the bore 102.

As shown in the drawings, the wheels 5 have a relatively large diameter. That is, the outer diameter of the wheels 5 is at least as large as the diameter, width or height of the section of the tool string 101 received within the opening 3 of the device 1. For example, the outer diameter of the wheels is at least as large as the diameter, width or height of the longitudinal opening 3 of the body or frame 2. The offset 8 between the rotational axis 6 of the wheels 5 and the longitudinal axis 7 of the tool string is less than 10% of the wheel diameter 5*c*.

With reference to FIG. 6, in the illustrated embodiment, a section diameter of the pair of wheels is greater than a maximum diameter of the tool string/sensor assembly. The 'section diameter' of the pair of wheels 5 is the diameter of a circular curve 5*b* drawn through the outer extremities of the pair of wheels 5. Alternatively, the 'section diameter' of the pair of wheels is the smallest diameter of a circular bore that the device could slip through. The section diameter of the pair of wheels may be at least 0.125 inch less than the minimum diameter of a bore in use.

In the illustrated embodiment, the wheels are shown as having circular curved sides or outer extremities, such that outer extremities of the pair of wheels lie on a circular curve. However, one skilled in the art will understand that the wheels may be otherwise shaped, such as having flat outer sides, or curved sides with an elliptical curvature. Regardless of the outer shape of the wheels, according to embodiments of the invention, a circular curve drawn through the outer extremities of the pair of wheels has a diameter greater than a maximum diameter of the tool string/sensor assembly.

Large diameter wheels 5 are preferred to reduce rolling friction and provide large bearings to support heavy tool strings. For example, the wheel diameter may be 1 to 2 times the diameter, width or height of the tool string/opening 3, or about 1.2 to 1.8 times the diameter, width or height of the tool string/opening 3. However, even with large diameter wheels 5, to position the centreline 7 of the tool string 101 at the centre of the wellbore 102, the rotational axis 6 of the wheels must be radially offset from the longitudinal axis 7 of the tool string, or radially offset from the longitudinal axis of the opening 3 of the body or frame 2 of the device 1.

To ensure the wheels 5 remain in contact with the wellbore wall 102*a* in a deviated section of the wellbore 102 the device 1 includes at least one eccentric weight 10. The weight 10 is positioned so that a centre of mass 11 of the combined device 1 and tool string 101 is offset from the longitudinal axis 7 of the tool string/frame opening 3 in the same radial direction that the rotational axis 6 is offset from the longitudinal axis 7 of the tool string/frame opening 3. That is, the centre off mass 11 is offset from the longitudinal axis 7 towards the side of the wellbore 102 that the wheels 5 contact. The rotational axis 6 of the wheels 5 and the centre of gravity 11 are on the same side of a plane coincident with the longitudinal axis of the tool string and parallel to the rotational axis 6 of the wheels 5. The eccentric weight 10 is positioned azimuthally between the wheels 5, so that the centre of gravity 11 of the combined device 1 and tool string 101 is positioned azimuthally between the wheels 5 with respect to the longitudinal axis 7 of the tool string. The weight 10 is azimuthally centered between the wheels 5 or positioned so that the centre of mass 11 is substantially azimuthally centered between the wheels 5. The centre of mass 11 of the combined device 1 and tool string is preferably located in a plane coincident with the longitudinal axis 7 of the tool string and perpendicular to the rotational axis 6 of the wheels 5.

The offset centre of mass 11 orients the device 1 and tool string 101 during use by gravity in a most stable position with the rotational axis 6 of the wheels 5 and the centre of mass 11 below the longitudinal axis 7 of the tool string and with the wheels 5 in contact with a low side of the wall 102*a* of the bore 102. The centre of mass 11 is below the rotational axis 6 of the wheels 5 with the wheels in contact with the low side of the wellbore 102. The shortest radial distance between the centre of mass 11 of the combined device 1 and tool string 101 and the wall 102*a* of the bore is when the pair of wheels 5 is in contact with the wall 102*a* of the bore 102. The eccentric weight 10 therefore causes the device 1 to remain on its wheels and therefore maintain the tool string 101 at the centre of the wellbore 102.

Preferably the centre of mass 11 is offset from the longitudinal axis 7 of the tool string 101 by the greatest possible distance. The greater the offset of the centre of mass, the greater a righting movement by gravity (orienting force by gravity) acting on the device and tool string to orient the device onto its wheels. The weight is configured so that the centre of mass 11 of the device and tool string is offset from the longitudinal axis 7 by a second radial distance 12 that is greater than the first radial distance 8 between the longitudinal axis 7 and the rotational axis of the wheels 6, refer to FIG. 6.

The device 1 comprises an engagement structure to connect the eccentric weight 10 to the tool string. Alternatively, or additionally the eccentric weight may be integrally formed with the body or frame 2 of the device supporting the wheels. Where the eccentric weight 10 and body or frame 2 carrying the wheels are separately connected to the tool string, the engagement structure connecting the wheels to the tool string and the engagement structure connecting the weight to the tool string both include features to prevent relative rotation between the tool string and the wheels and weight, so that the azimuthal positions of the wheels 5 and weight 10 are maintained, with the centre of mass 11 located azimuthally between the wheels 5. In the illustrated embodiment, the device comprises an engagement structure 14 for connecting the eccentric weight 10 to the tool string. The engagement structure 14 comprises two collars 13 configured to extend around the tool string 101 and mount the weight 10 eccentrically with respect to the longitudinal axis of the tool string and wheels 5, as described above. Each collar 13 may be formed in two or more parts bolted together to surround the tool string. A screw 4 extending through one or both collars 13 engages the tool string 101 to prevent relative rotation between the tool string 101 and the weight 10. In the illustrated embodiment the second engagement structure includes a frame 14 with the two spaced apart collars 13, the eccentric weight 10 attached to the frame 14 (by bolts 15). Each collar 13 has a screw 4 received through the collar to rotationally fix the collar 13 to the tool string 101. The illustrated embodiment comprises one eccentric weight attached to the tool string, however the device 1 may comprise one or more weights 10 configured to be attached to and longitudinally spaced apart along the tool string.

To maximise the offset between the longitudinal axis 7 of the tool string 101 and the centre of gravity 11 of the combined tool string 101 and device 1, the eccentric weight 10 may be configured to position the radial extremity 16 of the weight 10 adjacent the wellbore wall 102*a* when the wheels 5 are in contact with the wellbore wall, to provide a small gap between the radial extremity of the weight 10 and the wellbore wall 102*a*. For example, the weight may be configured to provide a radial gap of about ⅛ inch between the radial extremity 16 of the weight 10 and the wellbore wall 102*a*. The weight 10 has a curved radial extremity 16. The curvature of the radial extremity 16 may be substantially concentric with the curvature of the wellbore wall 102*a* to maximise the offset between the centre of mass 11 and the longitudinal axis 7.

The eccentric weight 10 ensures the device 1 remains on its wheels 5 in a deviated section of the wellbore 102, to ensure the tool string is located at the longitudinal centre of the wellbore. However, in a vertical section of the wellbore, the weight is ineffective in maintaining the wheels in contact with the wellbore wall. To ensure the wheels maintain contact with the wellbore wall in a vertical section of the wellbore, the device 1 may comprise one or more magnets 20 positioned to bias the device 1 against the wall 102*a* of the bore to maintain contact between the wheels 5 and the wall 102*a* of the bore 102. The wellbore wall 102*a* is constructed from magnetic material so that the magnets 20 bias the wheels 5 of the device 1 against the wall by a magnetic force.

The magnets 20 are offset from the longitudinal axis 7 of the tool string 101 in the same radial direction that the rotational axis 6 of the wheels 5 is offset from the longitudinal axis 7 of the tool string. That is, the magnets are offset from the longitudinal axis towards the side of the wellbore that the wheels contact. The shortest distance between the magnets 20 and the bore wall 102*a* is when the pair of wheels 5 is in contact with the wall of the bore 102. The rotational axis 6 of the wheels 5 and the magnets 20 are on the same side of a plane coincident with the longitudinal axis of the tool string and parallel to the rotational axis 6 of the wheels 5. The magnets 20 are positioned azimuthally between the wheels 5, so that the magnetic force is positioned azimuthally between the wheels 5 with respect to the longitudinal axis 7 of the tool string. The magnets are azimuthally centered between the wheels 5 or positioned so that the magnetic force substantially azimuthally centered between the wheels 5. The magnets 20 or magnetic force provided by the magnets may be located in a plane coincident with the longitudinal axis 7 of the tool string and perpendicular to the rotational axis 6 of the wheels 5. The magnets 20/magnetic force and the centre of mass 11 of the combined device 1 and tool string 101 are azimuthally aligned relative to the longitudinal axis 7 of the tool string 101 so that the magnetic biasing force provided by the magnets and the gravitational biasing force provided by the centre of mass 11 are in the same radial direction when the device traverses along a low side of the wellbore.

The magnets 20 may be positioned adjacent to the wellbore wall 102*a* when the wheels 5 are in contact with the wellbore wall. Magnetic flux decreases with the square root of distance so the magnets 20 should be close to the wellbore wall. For example, the magnets 20 are mounted to provide a radial gap of about ⅛ inch between the magnets 20 and the wellbore wall 102*a*. The magnets 20 are offset from the longitudinal axis 7 by a third radial distance (21, FIG. 6) greater than the second radial distance 12 between the centre of mass 11 and the longitudinal axis 7. In the illustrated embodiment, the magnets 20 are located at or adjacent the radial extremity of the eccentric weight 10. For example, the magnets are received in recesses in the eccentric weight 10 at the radial extremity 16 of the eccentric weight 10. The magnets 20 may be recessed slightly to prevent damage to an outer surface of the magnets.

The magnets operate to maintain contact between the wheels 5 and the bore wall 102*a* in vertical sections of the bore 102 where the centre of gravity 11 of the device 1 and tool string 101 is ineffective to orient the device 1. However, as the device 1 and tool string 101 travel from a vertical section to a deviated section, the offset centre of mass 11 causes the wheels 5 of the device 1 to move around the well bore wall to the low side of the bore by the action of the gravitational biasing force. The magnetic force should be less than the weight of the tool string. The magnetic biasing force required to maintain contact between the wheels 5 and the bore wall 102*a* in a vertical section of the bore is less than the weight of the tool string 101. The combination of a magnetic biasing force provided by magnets 20 and a gravity biasing force provided by an offset centre of mass 11 provides the benefit of maintaining contact between the wheels and the wellbore wall to centre the tool string in the bore in both vertical sections and deviated sections of the bore.

The diameter 5*c* and the lateral spacing 5*a* of the wheels 5 and radial offset 8 of the wheel rotational axis 6 are configured to centralise the tool string in the bore for a particular or known bore diameter. For any given wheel size and rotational axis offset, the device is configured for use in a single bore diameter or small range of bore diameters, to ensure the longitudinal axis of the tool string is substantially coincident with the longitudinal axis of the bore, i.e. within ±0.2 in.

In accordance with an aspect of the present invention, a kit of parts or system may be provided, to provide a device 1 as described above. The system comprises the body or frame 2 for rotationally supporting the wheels 5 and connecting the device 1 to the tool string 101, the eccentric weight 10, and a plurality of pairs of wheels 5*i*, 5*ii*, 5*iii*. Each pair of wheels is of a different diameter to the other pairs of wheels, with each pair of wheels together with the offset 8 between the rotational axis 6 of the wheels and the longitudinal axis 7 of the tool string corresponding to a particular bore diameter or diameter range. Thus, the plurality of wheels corresponds to a plurality of bore diameters or diameter ranges. The wheels are interchangeable couplable to the body or frame 2. The body or frame 2 comprises a pair of axles (9, FIG. 4A), and each pair of wheels 5 is interchangeably (releasably) couplable to the pair of axles 9. FIGS. 7A, 7B and 7C illustrate three different configurations for the device 1, a first configuration with a smaller diameter pair of wheels 5*i* for a smaller bore diameter or diameter range, a second configuration with an intermediate diameter pair of wheels 5*ii* for an intermediate bore diameter or diameter range, and a third configuration with a larger diameter pair of wheels 5*iii* for a larger bore diameter or diameter range. The system includes the body or frame 2, and the three pairs of wheels 5*i*, 5*ii*, 5*iii*.

The illustrated embodiment comprises three pairs of wheels, with diameters 5*c* of 2.7 inch, 3.0 inch and 3.5 inch and section diameters of 3.5 inch, 3.8 inch and 4.2 inch. The three different wheel diameters and the offset between the centre of the tool string and the rotational axis of the wheels provides for centering of a tool string in all wellbore casing sizes for casing with an outside diameter of 4.5 inches, 5 inches and 5.5 inches, as shown in the table below. As the casing weight increases, the wall thickness increases and the nominal diameter of the wellbore decreases. By example, a pair of wheels with a diameter of 3.5 inch and a section diameter of 4.2 inches is used for a 5.5 inch 17 lbs/ft casing, and a pair of wheels with a diameter of 2.7 inch and a section diameter of 3.5 inch is used for a 5.5 inch 40.5 lbs/ft casing. The table illustrates that the system comprising three pairs of wheels each presenting a different section diameter provides for a maximum offset between the centre of the tool string and the centre of the wellbore of 0.18 inches for all 4.5, 5 and 5.5 inch OD casing sizes.

| Size O.D. inch | Weight lbs/ft | Grade | Wall inch | Nominal I.D. inch | Drift Diameter * inch | Wheel Section diameter inch | Wheel diameter inch | Offset from centreline inch |
|---|---|---|---|---|---|---|---|---|
| 4½ | 11.6 | P-110 | 0.25 | 4.00 | 3.88 | 3.5 | 2.7 | 0.08 |
| 4½ | 13.5 | P-110 | 0.29 | 3.92 | 3.80 | 3.5 | 2.7 | 0.04 |
| 4½ | 15.1 | L-80 | 0.34 | 3.83 | 3.70 | 3.5 | 2.7 | 0.00 |
| 5 | 15 | J-55 | 0.30 | 4.41 | 4.28 | 3.8 | 3.0 | 0.14 |
| 5 | 21.4 | L-80 | 0.44 | 4.13 | 4.00 | 3.8 | 3.0 | 0.00 |
| 5 | 23.2 | L-80 | 0.48 | 4.04 | 3.92 | 3.8 | 3.0 | −0.05 |
| 5 | 24.1 | L-80 | 0.50 | 4.00 | 3.88 | 3.8 | 3.0 | −0.07 |
| 5½ | 17 | J-55 | 0.30 | 4.89 | 4.77 | 4.2 | 3.5 | 0.18 |
| 5½ | 23 | L-80 | 0.42 | 4.67 | 4.55 | 4.2 | 3.5 | 0.07 |
| 5½ | 26 | C-90 | 0.48 | 4.55 | 4.42 | 4.2 | 3.5 | 0.01 |
| 5½ | 26.8 | C-90 | 0.50 | 4.50 | 4.38 | 4.2 | 3.5 | −0.02 |
| 5½ | 29.7 | C-90 | 0.56 | 4.38 | 4.25 | 3.8 | 3.0 | 0.12 |
| 5½ | 32.6 | C-90 | 0.63 | 4.25 | 4.13 | 3.8 | 3.0 | 0.06 |
| 5½ | 35.3 | C-90 | 0.69 | 4.13 | 4.00 | 3.8 | 3.0 | 0.00 |
| 5½ | 38 | C-90 | 0.75 | 4.00 | 3.88 | 3.5 | 2.7 | 0.08 |
| 5½ | 40.5 | C-90 | 0.81 | 3.88 | 3.75 | 3.5 | 2.7 | 0.02 |
| 5½ | 43.1 | C-90 | 0.88 | 3.75 | 3.63 | 3.5 | 2.7 | −0.04 |

* Drift diameter is the minimum diameter of a casing pipe guaranteed by a manufacturer, determined by a drift (a plug) passed though the pipe.

Figure 10A:
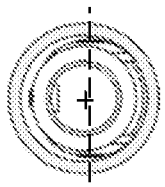
FIGS. 10A(I) and 10A(II) illustrate the body or frame and wheels of FIGS. 7A(I) to 7A(III) and the eccentric weight of FIGS. 8A(I) and 8A(II) attached to a tool string within a bore.
Figure 10A:
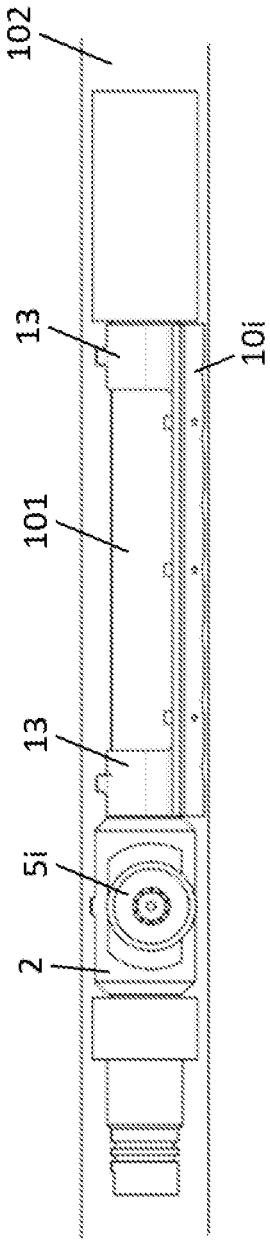
Figure 10B:
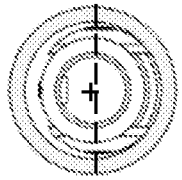
FIGS. 10B(I) and 10B(II) illustrate the body or frame and wheels of FIGS. 7B(I) to 7B(III) and the eccentric weight of FIGS. 8B(I) and 8B(II) attached to a tool string within a bore.
Figure 10B:
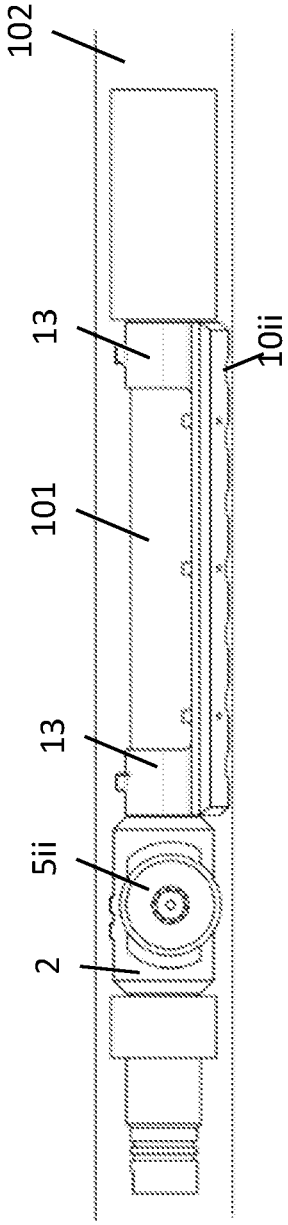
Figure 10C:
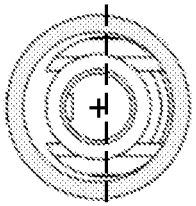
FIGS. 10C(I) and 10C(II) illustrate the body or frame and wheels of FIGS. 7C(I) to 7C(III) and the eccentric weight of FIGS. 8C(I) and 8C(II) attached to a tool string within a bore.
Figure 10C:
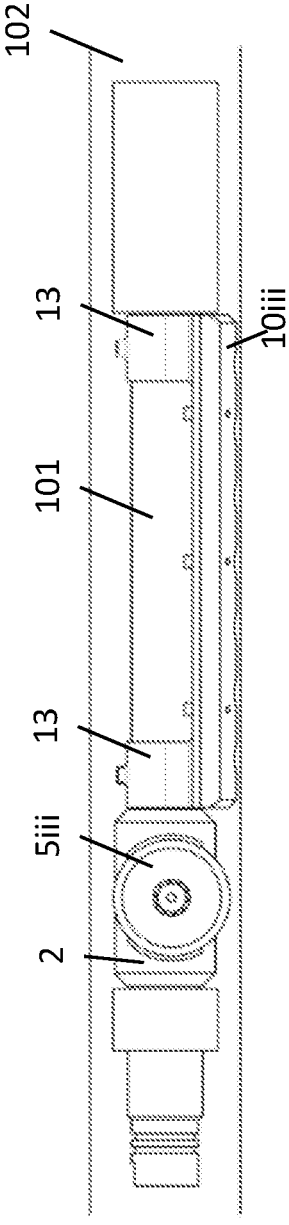

By example:

FIGS. 10A(I) and 10A(II) illustrate the device with a 2.7 in wheel diameter in a 4.5 in, 15.1 ppf, 3.83 nominal ID casing, FIGS. 10B(I) and 10B(II) illustrate the device with a 3.0 in wheel diameter in a 5 in, 21.4 ppf, 4.13 nominal ID casing, and FIGS. 10C(I) and 10C(II) illustrate the device with a 3.5 in wheel diameter in a 5.5 in, 26.8 ppf, 4.5 in nominal ID casing.

Figure 9:
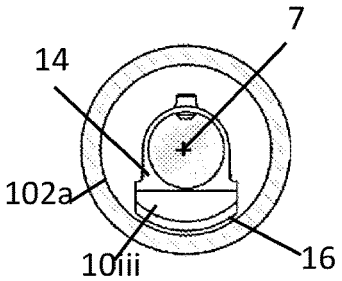
FIG. 9 provides an isometric view of a plurality of weights and a frame for connecting each weight of the plurality of weights to the tool string.
Figure 9:
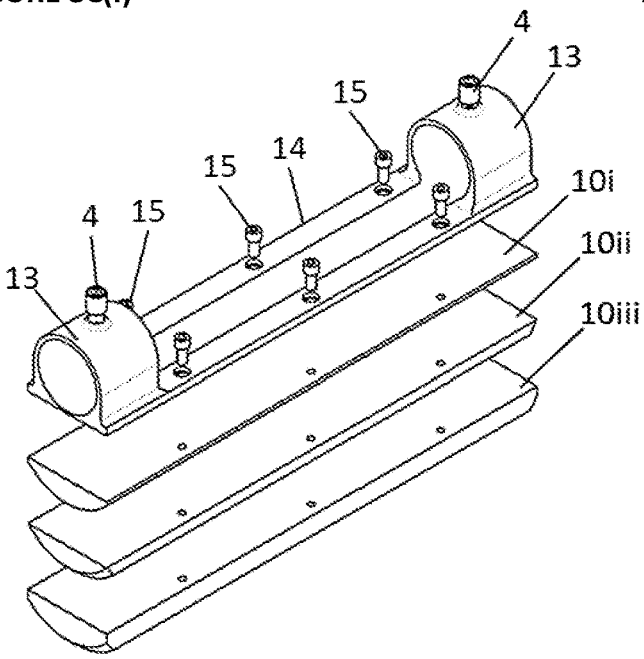

As shown in FIGS. 9 and 10A to 10C, in some embodiments, the system also comprises a plurality of eccentric weights 10*i*, 10*ii*, 10*iii* corresponding to the plurality of bore diameters or diameter ranges. As described above, to maximise the offset 12 between the longitudinal axis 7 of the tool string 101 and the centre of gravity 11 of the combined tool string 101 and device 1 to maximise an orienting force by gravity, the eccentric weight 10*i*, 10*ii*, 10*iii* may be configured to position the radial extremity 16 of the weight 10*i*, 10*ii*, 10*iii* adjacent the wellbore wall 102*a* when the wheels 5 are in contact with the wellbore wall 102*a*, to provide a small radial gap between the weight 10*i*, 10*ii*, 10*iii* and the wellbore wall 102*a*. Thus, each weight 10*i*, 10*ii*, 10*iii* of the plurality of weights has a different radial height corresponding with a bore diameter or diameter range, to position the radial extremity 16 of the eccentric weight 10*i*, 10*ii*, 10*iii* adjacent the bore wall. For example, each weight may be configured to provide a radial gap of about ⅛ inch between the radial extremity 16 of the weight 10*i*, 10*ii*, 10*iii* and the wellbore wall of the particular bore diameter or diameter range. Each weight may be of a different mass to the other weights. As shown in FIG. 9, the system may comprise the plurality of weights 10*i*, 10*ii*, 10*iii* and the frame 14 for attaching the eccentric weight 10*i*, 10*ii*, 10*iii* to the tool string via bolts 15. One weight (e.g. 10*i*) may be removed from the frame 14 and replaced with one of the other weights (e.g. 10*ii*) to correspond with a particular bore diameter or diameter range.

Figure 11:
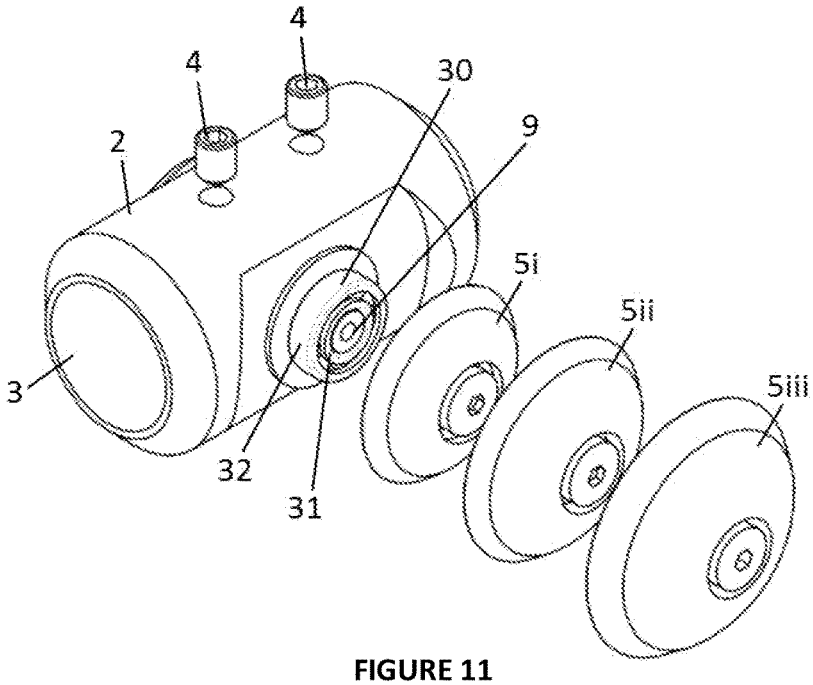
FIG. 11 provides an isometric view of a body or frame for the device of FIGS. 3A to 3F with three wheels from a plurality of pairs of wheels.

To releasably attach the wheels 5 to the frame or body 2, the device 1 comprises a bearing assembly 30. The bearing assembly may be mounted to each wheel, and each wheel 5 with bearing 30 is interchangeably mountable to the axle 9. FIG. 11 shows the wheels separated from the bearings, however, in such an embodiment the bearing 30 remains attached to the wheel 5, and the bearing 30 is releasably mounted to the axle 9 and retained on the axle by a screw. In the field of use, an operator may remove one pair of wheels (e.g. 5*i*) and bearings 30 from the axles 9 and mount another pair of wheels (e.g. 5*ii*) and bearings to suit a particular bore size. For example, the bearing assembly 30 comprises an inner race 31 to be received on the axle 9 and an outer race 32 rotationally coupled to the inner race via bearing elements such as ball bearings or the like. The wheel 5 is mounted to the outer race 32, for example the outer race may be pressed into the wheel.

Figure 12:
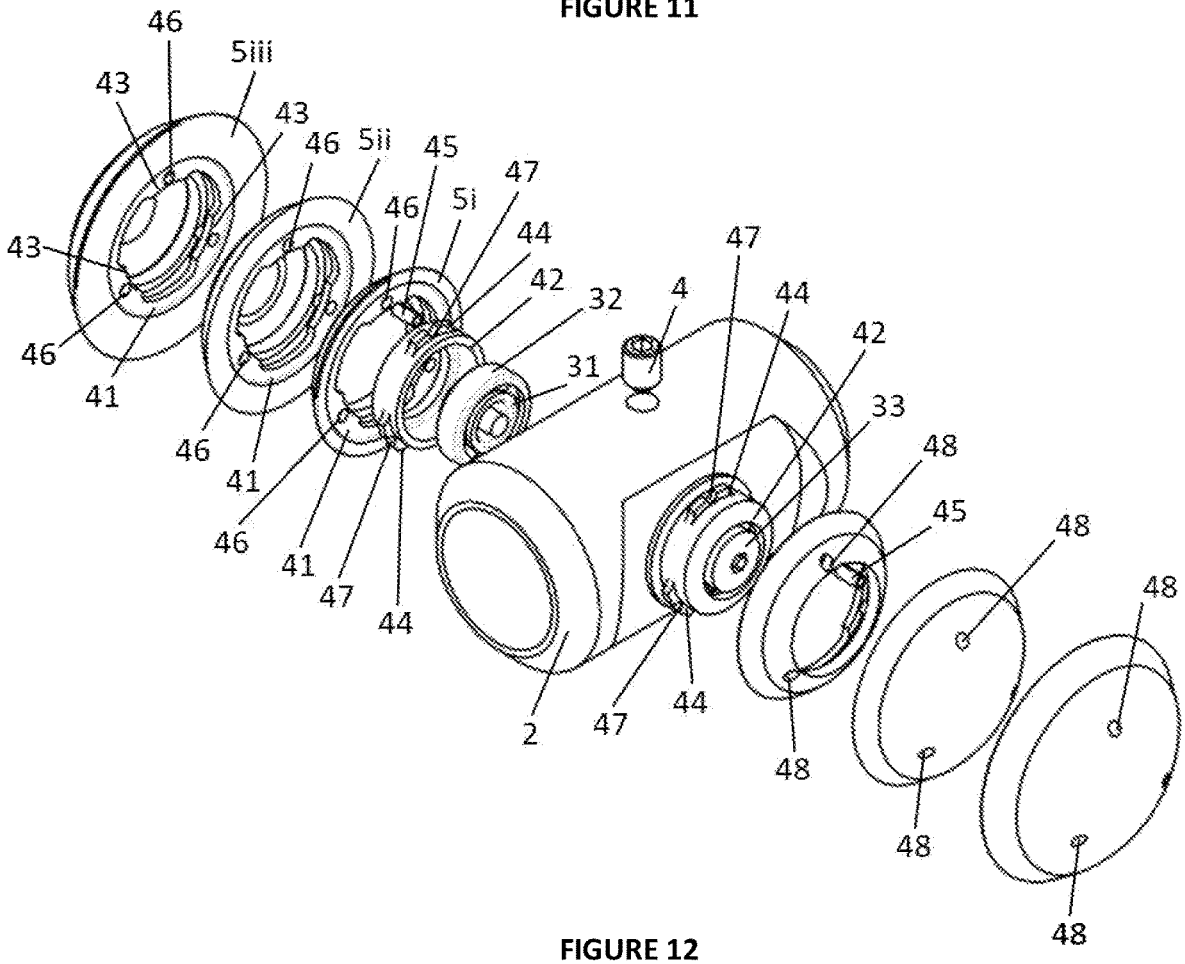
FIG. 12 provides an isometric view of a body or frame for the device of FIGS. 3A to 3F with three wheels from a plurality of pairs of wheels and including an interface structure for attaching each wheel to a bearing assembly of the device.

With reference to FIG. 12, in the illustrated embodiment the device 1 comprises an interface structure to releasably attach the wheel 5 to the bearing assembly 30 mounted on the axle 9. The bearings 30 remain attached to the axles 9 as part of a frame assembly together with the frame or body 2 of the device 1. The inner race 31 of the bearing is fixed to the axle, for example, the inner race is pressed on to the axle 9.

The interface structure comprises a first connector part 41 attached to the wheel 5 and a second connector part 42 attached to the bearing assembly 30. The first and second connector parts 41, 42 comprise complementary features engaged by relative rotation between the two parts 41, 42, and therefore between the wheel 5 and the bearing assembly 30, to mount the wheel 5 to the bearing assembly 30. The illustrated embodiment the first connector part 41 comprises a plurality of radially inwardly extending projections 43, and the second connector part 42 comprises a plurality of radially outwardly extending projections 44. The inward and outward projections 43, 44 are azimuthally misaligned to place the wheel 5 onto the bearing assembly 30, and then the wheel 5 is rotated relative to the bearing assembly 30 to azimuthally align the inward and outward projections 43, 44 to engage the inward and outward projections 43, 44, with a laterally outward facing surface of the inward projections engaging a laterally inward facing surface of the outward projections, to releasably mount the wheel 5 to the axle 9 and bearing assembly 30.

In the illustrated embodiment the first connector part 41 is comprises an annular member comprising the inward projections 43 extending from an inner circumference of the ring 41. The ring 41 is fitted to an inner face of the wheel 5 or may be integrally formed with the wheel. The wheel 5 has a cavity to receive the second connector part 42 when the wheel is fitted to the bearing assembly 30. The second connector part 42 comprises an annular member fitted/pressed onto the outer race 32 of the bearing assembly 30, such that there is no relative rotation between the bearing race 32 and the second connector part 42. The radially outward projections 44 extend outwards from the annular member 42 of the second connector part. The bearing assembly 30 and second connector part 42 are attached to the axle 9 via the inner race 31 of the bearing. For example, the inner race is press fit onto the axle 9 or is held on the axle via a fastener 33. Thus, the bearing 30 and second connector part 42 remain fixed to the axle 9 and are part of a frame assembly together with the body or frame 2 of the device 1.

The device 1 may further comprise a locking mechanism to lock the wheel 5 to the bearing 30 and axle 9 to prevent the wheel 5 coming loose and falling off the axle during use. The illustrated embodiment includes a locking member or pin 45 to lock the first and second connector parts 41, 42 together. The pin may be a tension pin or coiled spring pin. One or more of each of the inward projections 43 comprises an aperture or slot 46 and each of the outward projections 44 comprises a corresponding aperture or slot 47. Once the wheel 5 has been rotated onto the bearing assembly 30 and the inward and outward projections 43, 44 are engaged (azimuthally aligned), the aperture or slot 46 on at least one inward projection 43 is azimuthally aligned with the aperture or slot 47 on at least one corresponding outward projection 44. The locking pin 45 may be pressed into the aligned apertures/slots 46, 47, to prevent relative rotation between the first and second connector parts 41, 42, to prevent the wheel 5 releasing from the body or frame 2 in use. In the illustrated embodiment, the wheel 5 comprises an aperture 48 extending through the wheel 5 from an outer side of the wheel, the aperture aligned with the aperture/slot in the first connector part 41, so that the pin 45 can be pressed into the first and second connector parts 41, 42 from the outside of the wheel 5. To remove the pin 45, the pin may be knocked completely through the wheel and beyond at least the first connector part 41 to allow the wheel 5 and first connector part 41 to be rotated off the second connector part 42 and removed from the bearing assembly 30 and axle 9.

Figure 13:
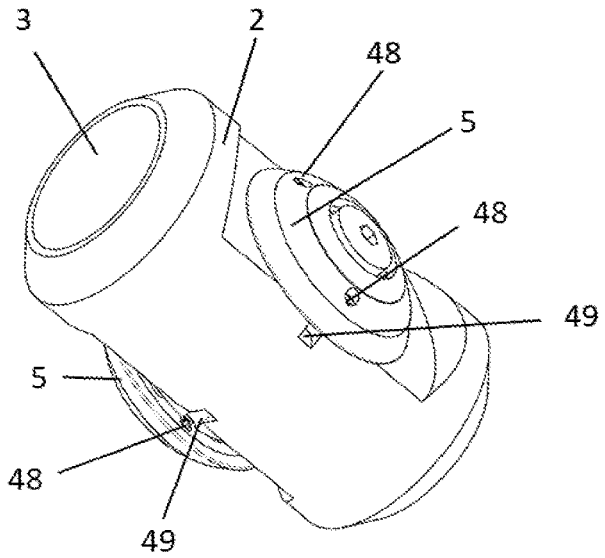
FIG. 13 provides a bottom isometric view of the body and wheels shown in FIG. 12.

As shown in FIG. 13 the body may comprise a recess 49 to receive the pin 45 when knocked completely through the first and second connector parts 41, 42 from the outer side of the wheel 5. The pin may be knocked completely through the first and second connector part 41, 42 from the outside of the wheel into the recess to allow the wheel to be removed. Once a wheel is attached to the bearing via the first and second connector parts 41, 42, the pin may be reinserted from the outside of the wheel 5 through the aperture 48 through the wheel to lock the wheel 5 to the bearing 30.

Figure 14:
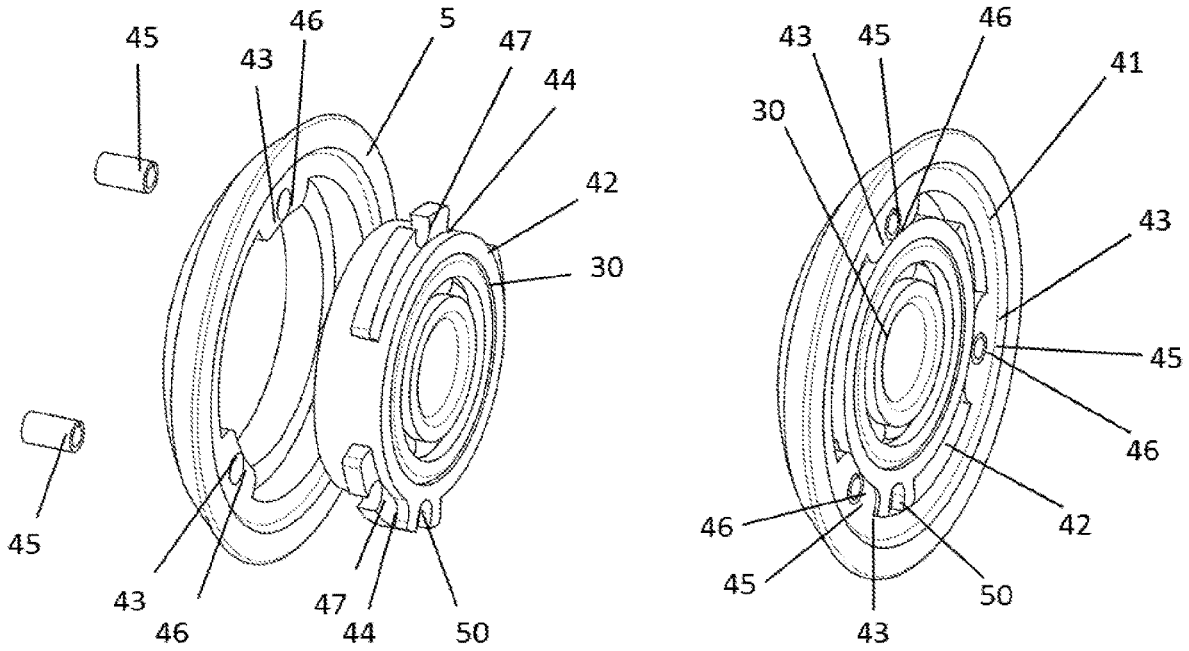
FIG. 14 provides an exploded view of a wheel and an interface structure for connecting the wheel to a bearing assembly.

With reference to FIGS. 13 and 14, to allow a wheel to be rotated onto and off the second connector part 42 and bearing 30, the second connector part comprises a recess 50. The recess 50 may be aligned with recess 49 in the body 2, to accept a bar or other tool (not shown) in the aligned recesses 49 and 50, to rotationally lock the second connector part and bearing to the body 2 to prevent rotation of the bearing and second connector part. A suitable tool may comprise a L shaped bar to allow a user to insert a portion of the bar into the recess 49 in the body and the recess 50 in the second connector part. The wheel 5 may then be attached to and removed from the second connector part 42 with the bearing 30 and second connector part 42 held stationary.

A device according to one aspect of the present invention as described above provides one or more of the following benefits.

- The device 1 provides a means to centre a tool string in a wellbore to provide high quality logging data without a centering force applied between opposed sides of the wellbore like in a traditional centralising device. The pair of wheels contact one side of the wellbore only. This provides lower rolling friction and therefore less force impeding the travel of the device downhole.
- The heavy weight of the tool string is carried by wheels that have a much larger diameter than conventional centralising devices, reducing rolling friction to assist travel of the device and tool string down hole, including in deviated bores.
- Large diameter wheels allow accommodation space for efficient rolling elements, such as ball bearings or roller bearings. Rolling element bearings are more efficient than plain bearings utilised in conventions centralisers due to space constraints resulting from a requirement for small diameter wheels or rollers (in the order of 20 mm diameter).
- The device centralises a tool string in a small diameter pipe (e.g. 5.5 in and less), where conventional centralisers fail.
- The device is a passive device. No power input, such as electrical or hydraulic power provided from surface located power units is required. The invention therefore provides a lower cost, effective, and simplified device that provides improved operational reliability and accuracy of logged data.
- The device is robust and provides a small number of moving parts reducing maintenance requirements and improving reliability.
- When provided as a system comprising a plurality of wheels, or plurality of wheels and plurality of eccentric weights, the system provides for a device configurable for a desired wellbore diameter or diameter range. By providing three pairs or sets of wheels, the invention provides for low friction and accurate centering for all 4.5, 5.0 and 5.5 OD casing weights.

The invention has been described with reference to device for transporting a tool string/sensor assembly in a wellbore during a wireline logging operation. However, a device according to the present invention may be used for carrying and centering a sensor assembly in a bore in other applications, for example to center a camera in a pipe for inspection purposes.

Although this invention has been described by way of example and with reference to possible embodiments thereof, it is to be understood that modifications or improvements may be made thereto without departing from the spirit or scope of the appended claims.

The invention claimed is:

1. A device for transporting a sensor assembly down a bore of a known diameter with the sensor assembly centred in the bore, the device comprising:

at least one engagement structure to rotationally fix the device to the sensor assembly;

a pair of wheels arranged to rotate about an axis of rotation substantially perpendicular to and offset in a radial direction by a first radial distance from a central longitudinal axis of the sensor assembly when the device is connected to the sensor assembly; and at least one eccentric weight;

wherein the first radial distance and a lateral distance between the wheels and a diameter of the wheels configures the device so that, in use, the central longitudinal axis of the sensor assembly is substantially coincident with a central longitudinal axis of the bore when the wheels are in contact with a wall of the bore; and wherein the at least one eccentric weight is positioned so that a centre of mass of the combined device and sensor assembly is offset in the radial direction from the central longitudinal axis of the sensor assembly by a second radial distance that is greater than the first radial distance, to orient the device and sensor assembly by gravity during use in a most stable position with the rotational axis of the wheels and the centre of mass below the central longitudinal axis of the sensor assembly with the wheels in contact with a low side of the wall of the bore.

2. The device as claimed in claim 1, wherein the rotational axis of the wheels and the centre of mass are on the same side of a plane parallel to the rotational axis of the wheels and coincident with the central longitudinal axis of the sensor assembly.

3. The device as claimed in claim 1, wherein the centre of mass of the combined device and sensor assembly is located in a plane coincident with the central longitudinal axis of the sensor assembly and perpendicular to the rotational axis of the wheels.

4. The device as claimed in claim 1, wherein the shortest distance between the centre of mass of the combined device and sensor assembly and the wall of the bore is when the pair of wheels is in contact with the wall of the bore.

5. The device as claimed in claim 1, wherein a radial extremity of the eccentric weight is adjacent the wall of the bore when the wheels are in contact with the wall of the bore.

6. The device as claimed in claim 1, wherein the wheels have a diameter greater than or equal to a diameter, height, or width of the sensor assembly.

7. The device as claimed in claim 1, wherein a section diameter of the pair of wheels is greater than a maximum outside diameter of the sensor assembly.

8. The device as claimed in claim 1, wherein the device is configured for use in a bore with a wall comprising a magnetic material and the device comprises one or more magnets positioned to bias the device against the wall of the bore by a magnetic force to maintain contact between the pair of wheels and the wall of the bore.

9. The device as claimed in claim 8, wherein the magnets or the magnetic force and the centre of mass of the combined device and sensor assembly are azimuthally aligned with respect to a central longitudinal axis of the sensor assembly.

10. The device as claimed in claim 8, wherein the magnets are offset from the central longitudinal axis by a third radial distance to be positioned adjacent to the wall of the bore with the wheels in contact with the wall of the bore.

11. The device as claimed in claim 8, wherein the magnets are located at a radial extremity of the eccentric weight.

12. The device as claimed in claim 8, wherein the magnetic force is less than a weight of the sensor assembly.

13. The device as claimed in claim 8, wherein the shortest distance between the magnets and the bore wall is when the pair of wheels is in contact with the wall of the bore.

14. The device as claimed in claim 8, wherein the magnets provide a magnetic force sufficient to maintain contact between the wheels and the wall of the bore in a vertical section of the bore.

15. The device as claimed in claim 8, wherein with the wheels in contact with a low side of a deviated section of the bore the magnetic force and the orienting force by gravity are azimuthally aligned.

16. A system for providing a device as claimed in claim 1, the system comprising:

a body or frame providing the at least one engagement structure and comprising axles for rotationally supporting the pair of wheels to rotate on the rotational axis, the at least one eccentric weight, and a plurality of said pairs of wheels, each pair of wheels being of a different diameter to the other pairs of wheels, the plurality of pairs of wheels corresponding to a plurality of bore diameters or bore diameter ranges, and wherein each pair of wheels is interchangeably couplable to the axles to selectively configure the device for use in a bore having a diameter selected from the plurality of bore diameters or diameter ranges, such that, in use, the central longitudinal axis of the sensor assembly is substantially coincident with the central longitudinal axis of the bore of the selected diameter when the wheels are in contact with the wall of the bore.

17. The system as claimed in claim 16, wherein the system comprises:

a plurality of eccentric weights, each weight having a different radial height to the other eccentric weights, the plurality of eccentric weights corresponding to the plurality of bore diameters or diameter ranges.

18. The system as claimed in claim 16, wherein the body or frame is a frame assembly comprising a bearing assembly mounted to each axle, and wherein each pair of wheels is interchangeably mountable to the bearing assemblies.

19. The system as claimed in claim 18, wherein the device comprises an interface structure to releasably mount each wheel to a respective bearing assembly.

20. The system as claimed in claim 19, wherein the interface structure comprises a first connector part attached to the wheel and a second connector part attached to the bearing assembly, the first and second connector parts comprising complementary features configured to engage to releasably retain the wheel on the bearing.

21. A method for transporting a sensor assembly down a bore, the method comprising:

providing a system as claimed in claim 16, and selecting a said pair of wheels from the plurality of pairs of wheels corresponding to a diameter of the bore, connecting the selected pair of wheels to the axles, connecting the device to the sensor assembly, and conveying the device and sensor assembly down a bore with the wheels in contact with the wall of the bore so that the central longitudinal axis of the sensor assembly is substantially coincident with the central longitudinal axis of the bore and with the device and sensor assembly oriented by gravity in the most stable position with the rotational axis of the wheels and the centre of mass below the central longitudinal axis of the sensor assembly when the wheels are in contact with a low side of the wall in a deviated section of the bore.

22. The method as claimed in claim 21, wherein the system comprises a plurality of eccentric weights and the method comprises:

selecting a said weight with a radial height corresponding to the diameter of the bore, and connecting the wheels and eccentric weight to the sensor assembly.

23. A method for transporting a sensor assembly down a bore, the method comprising:

providing a device as claimed claim 1, and connecting the device to the sensor assembly, and conveying the device and sensor assembly down a bore with the wheels in contact with the wall of the bore so that the central longitudinal axis of the sensor assembly is substantially coincident with the central longitudinal axis of the bore and with the device and sensor assembly oriented by gravity in the most stable position with the rotational axis of the wheels and the centre of mass below the central longitudinal axis of the sensor assembly when the wheels are in contact with a low side of the wall in a deviated section of the bore.

* * * * *